US005192007A

United States Patent [19]

Blomquist

[11] Patent Number: 5,192,007

[45] Date of Patent: Mar. 9, 1993

[54] VALVE ASSEMBLY FOR INVERTED DISPENSING FROM A CONTAINER WITH A PUMP

[75] Inventor: Leonard A. Blomquist, Williamsburg, Va.

[73] Assignee: Continental Plastic Containers, Inc., Norwalk, Conn.

[21] Appl. No.: 631,958

[22] Filed: Dec. 21, 1990

[51] Int. Cl.[5] ..... B67D 5/00

[52] U.S. Cl. ..... 222/376; 222/383; 239/333; 137/512.3

[58] Field of Search ..... 137/512, 512.3; 222/402.19, 383, 376; 239/333; 169/30, 33, 72, 89

[56] References Cited

U.S. PATENT DOCUMENTS

| | | | |
|---|---|---|---|
| 4,277,001 | 7/1981 | Nozawa | 222/402.19 X |
| 4,371,098 | 2/1983 | Nozawa et al. | 222/376 X |
| 4,678,122 | 7/1987 | Riglietti | 222/383 X |
| 4,775,079 | 10/1988 | Grothoff | 222/402.19 X |
| 4,863,071 | 9/1989 | Guss et al. | 222/383 X |
| 4,942,985 | 7/1990 | Schultz | 222/402.19 X |

*Primary Examiner*—Andres Kashnikow
*Assistant Examiner*—A. Pomrening
*Attorney, Agent, or Firm*—Eugene F. Friedman

[57] ABSTRACT

A valve assembly which may be incorporated in a pump and container arrangement so as to permit the dispensing of liquid from the container when the container is in an inverted position as well as when the container is in its normal upright position. The valve assembly is primarily formed by a disc which has formed as part thereof a valve unit. The valve unit, in turn, is provided with a vent passage therethrough which is normally closed in the inverted position of the unit and a liquid passage which is normally closed in the upright position of the valve assembly. The liquid passage is opened by the weight of the liquid within the container on the ball check valve thereof when the container is inverted.

20 Claims, 3 Drawing Sheets

VALVE ASSEMBLY FOR INVERTED DISPENSING FROM A CONTAINER WITH A PUMP

This invention relates in general to new and useful improvements in dispensing type containers for liquids wherein a liquid product may be dispensed when the container is in an inverted position.

BACKGROUND OF INVENTION

It is customary to provide dispensers for liquids such as window washing liquids and the like with a pump. Such pump is normally provided with a pickup tube which is carried by the pump and extends into the container. More recently, there has been developed a pump and valve arrangement wherein a conventional type of pump may be utilized in conjunction with a container having an integral pickup tube separate and apart from the mouth and general body of such container. This greatly facilitates the assembling of the pump with the container.

More recently there has been developed a valve assembly which permits the pump to be selectively rotationally oriented relative to the container to facilitate dispensing of liquids from different angles. However, none of the various pump and container arrangements permits the container to be inverted and the liquid product therein to be pumped out while in such inverted position.

SUMMARY OF THE INVENTION

In accordance with this invention, a prior developed valve assembly for selectively coupling a pump to a container with an integral pickup tube to permit dispensing with the pump in selected angles relative to the container has been further improved by providing a valve assembly which permits the container to be inverted and the liquid contained therein pumped in a normal manner. This valve assembly most specifically includes a disc which is to be positioned between and sealed to both the container and the pump and which disc carries a valve unit having a through vent passage and a through liquid passage. Each of these two passages is provided with a check valve, preferably of the metal ball type.

The vent passage has a downwardly facing valve seat and thus is opened when the valve assembly is in an upright position, but closed when the valve assembly is in an inverted position The liquid passage has an upwardly facing valve seat and the ball check valve is normally held on that valve seat by a light spring pressure which can be readily overcome by the weight of the liquid within the container pressing on the ball check valve.

The aforementioned valve assembly permits one to dispense a liquid from an ordinary container with or without a pickup tube. On the other hand, in accordance with this invention, if the liquid is to be dispensed when the container is in an upright position, and the container is provided with an integral pickup tube, then the valve assembly must also have a pickup passage that communicates with the same pump inlet as does the liquid passage.

Most specifically, the liquid passage is in the form of a bore having a seat at its lower end and a ball check valve normally held in sealed relation with the seat by a light spring. The light spring is carried by a spring retainer which is positioned within the bore. The spring retainer has a through central bore and axial recesses circumferentially spaced about its exterior. The spring retainer, the spring and the ball check valve are held in the bore which defines the fluid passage by way of a metal foil tape. The metal foil tape has openings therethrough aligned with the center bore and recesses of the spring retainer.

With the above and other objects in view that will hereinafter appear, the nature of the invention will be more clearly understood by reference to the following detailed description, the appended claims, and the several views illustrated in the accompanying drawings.

DESCRIPTION OF PREFERRED EMBODIMENT OF INVENTION

Figure 1:
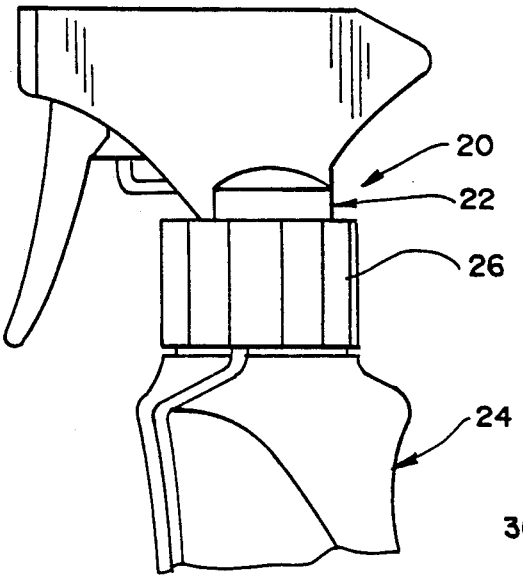
FIG. 1 is an elevation of an upper part of a container, a pump and a valve assembly in accordance with this invention.

Referring now to the drawings in detail, it will be seen that there is illustrated in FIG. 1 a pump and container combination which utilizes the valve assembly which is the subject of the invention, the pump and container combination being generally identified by the numeral 20. The pump is generally identified by the numeral 22 and is removably secured to the container 24 by a nut 26 carried by the pump.

Figure 2:
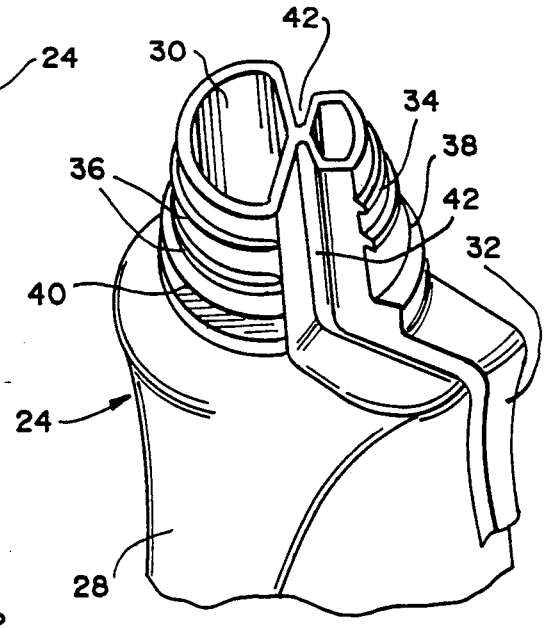
FIG. 2 is a fragmentary top perspective view of a container utilized in accordance with this invention.

Referring now to FIG. 2, it will be seen that the container 24 is of a special construction and in addition to including a body 28 having a mouth 30, the container 24 is provided with an integral pickup tube 32.

It will be seen that portions of the pickup tube and the neck finish of the container mouth 30 include threads 34, 36 with which the nut 26 is engaged to releasably secure the pump 22 to the container 24. It will also be noted that adjacent portions of the pickup tube neck finish 38 and the container mouth neck finish 40 are arranged in a generally V-shaped formation 42 on each side of the container as is clearly shown in FIG. 5.

Figure 3:
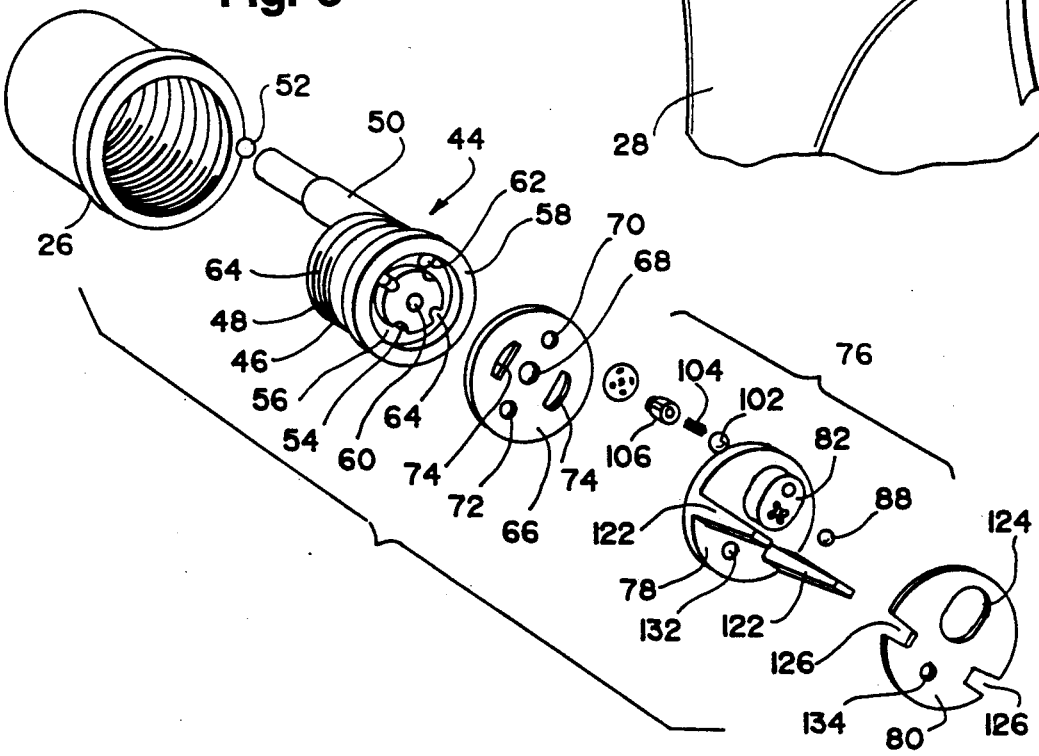
FIG. 3 is an exploded perspective view of portions of the pump and the various components of the valve assembly.

Referring now to FIG. 3, it will be seen that the pump nut 26 is carried by a pump control unit generally identified by the numeral 44. The pump control unit 44 includes a body 46 having projecting ribs 48 which serve to lock the pump control unit 44 within the pump body when pressed into place.

The pump control unit 44 has extending upwardly from the body 46 a pickup tube 50 which will be suitably connected to the pumping cylinder (not shown) of the pump and is provided with a customary check valve 52 of the ball type.

The lower end of the flow control unit 44 includes a central plug 54 which is defined by an annular recess 56 disposed within an annular outer portion 58 of the body 46. The plug 54 has a face which is coplanar with the face of the annular outer portion 58 so that a seal may be formed therewith.

The plug 54 is provided with a central vent opening 60 while at the bottom of the annular recess 56 there is a pickup opening 62 which is aligned with the pickup tube 50.

Further, the outer surface of the plug 54 is provided with diametrically opposite, axially extending recesses 64 the purpose of which will be described in detail hereinafter.

Next, there is a pump side gasket 66 which forms a seal with the faces of the plug 54 and the annular outer portion 58. This gasket is provided with a central bore 68 and two outer bores 70, 72 in radial alignment therewith. Also, the gasket 66 is provided with suitable openings 74 the purpose of which will be described hereinafter.

Next there is illustrated the valve assembly which is the primary feature of this invention, the valve assembly being generally identified by the numeral 76. The valve assembly 76, among other elements, includes a disc 78 which is engaged by the gasket 66 and forms a seal therewith. The disc 78 has the opposite face thereof engaged by a container side gasket 80 so as to form a seal between the disc 78 and the sealing face of the container 24.

While the general details of the valve assembly 76 are shown in FIG. 3, the valve assembly 76 is shown in much greater detail in FIGS. 6–9. First of all, the disc 78 has outwardly formed therewith a valve unit body 82 which projects axially from the container side of the disc 78. The valve unit body 82 is provided with a vent passage 84 which extends through the body 82 and which is provided intermediate its ends with a valve seat 86 which faces towards the container 26 and which has associated therewith a metal ball check valve 88. The end of the vent passage 84 facing the container is provided with a plurality of fingers 90 which permits the ball 88 to be snapped into a ball retaining space 92 which is of an axial size to permit the ball 88 to unseat from the valve seat 86.

It is to be understood that the vent passage 84 is offset from an axial center of the valve assembly 76 and thus from the vent opening 60. In order that the vent passage 84 may communicate with the vent opening 60, there is formed in the pump face of the disc 78 a transverse recess 96 which communicates with the vent opening 60 through the opening 68 in the gasket 66.

Figure 11:
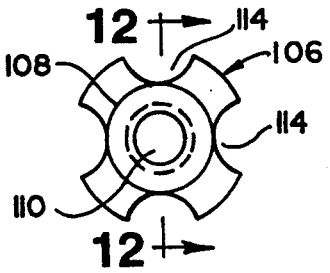
FIG. 11 is a top plan view of a spring retainer.
Figure 12:
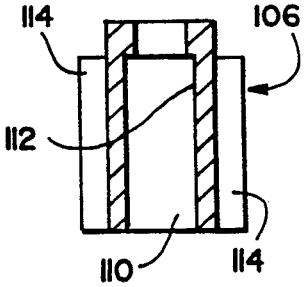
FIG. 12 is a vertical sectional view taken generally along the line 12—12 of FIG. 11 and shows the specific cross section of the spring retainer.

The valve unit body 82 is also provided with a through bore in the form of a liquid passage 98 which has adjacent its lower end a valve seat 100 that faces the pump. A metal ball check valve 102 is seatable on the check valve 100 and is normally retained in that position by a light spring 104 which is carried by a spring retainer 106. The spring retainer 106 is best shown in FIGS. 11 and 12. The spring retainer 106 is of a generally circular cross section and includes a circular cross sectional center body portion 108. The body portion 108 is provided with a stepped bore 110 therethrough which defines a shoulder 112 against which that end of the spring 104 remote from the metal ball 102 seats.

Surrounding the body portion 108 is a plurality of circular cross sectional axial recesses 114. It is to be understood that liquid being pumped flows through the bore 110 and the axially extending recesses 114.

Figure 6:
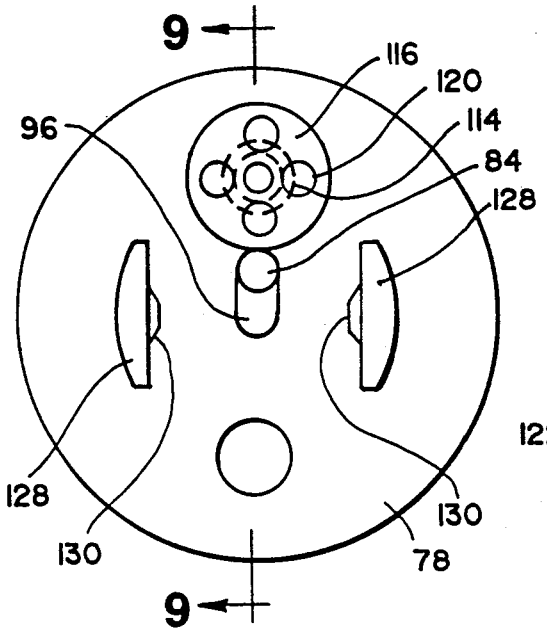
FIG. 6 is a top plan view of the valve assembly including a disc which is sealed between the container and the pump.
Figure 7:
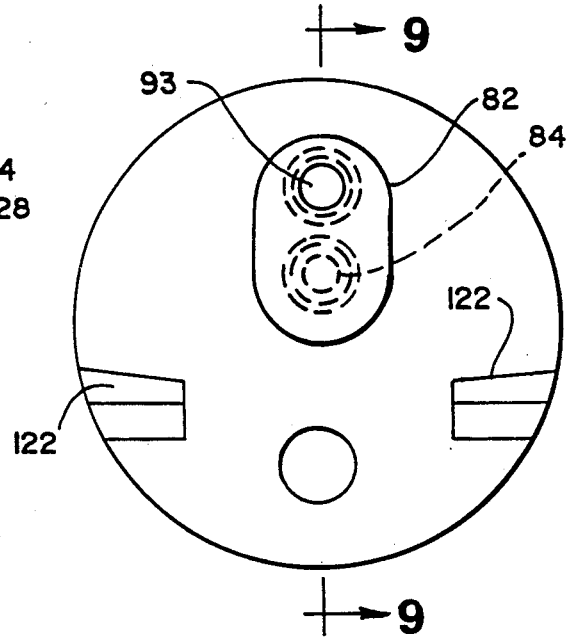
FIG. 7 is a bottom plan view of the valve assembly and shows further details thereof.
Figure 9:
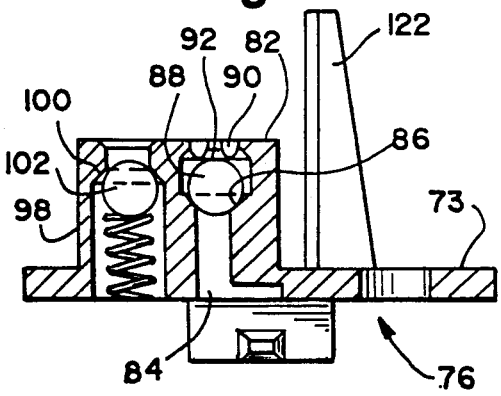
FIG. 9 is a vertical sectional view taken generally along the line 9—9 of FIG. 6 and shows specifically the details of the valve assembly.
Figure 10:
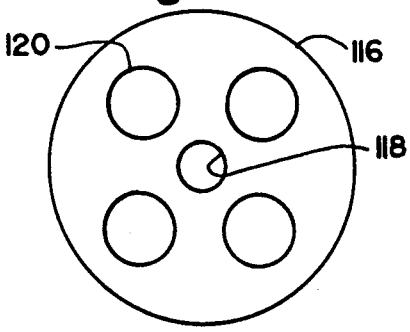
FIG. 10 is a plan view of a metal foil tape spring retainer.

With reference now to FIG. 10, it will be seen that there is illustrated a metal foil tape 116 which is circular in outline and which is provided with a suitable adhesive on one face thereof. This material is conventional and is of the peel and stick type. The tape 116 has punched therein a central opening 118 for alignment with the bore 110 and outer openings 120 arranged in a circular pattern for alignment with the recesses 114. This partial alignment of the openings 120 with the recesses 114 is best shown in FIG. 6.

It is to be understood that the metal foil tape 116 bonds to the pump face of the disc 78 and serves to retain the spring retainer 106, the spring 104 and the ball check valve 102 within the fluid passage 98.

It is to be understood at this time that the openings 118, 120 are in at least partial communication with the opening 70 through the gasket 66. The opening 70 places these openings in communication with the annular recess 56 and the pickup opening 62.

The disc 78 has projecting from the container side thereof a pair of alignment members 122 which are of a tapered configuration and which are shaped to fit within the V-formations 42 of the container neck finish. In this manner the valve assembly 76 is oriented with the container neck finish configuration.

As is clearly shown in FIG. 3, the container side gasket 80 is circular in outline and is provided with a large oval shaped opening 124 to permit the passage of the valve unit body 82 therethrough into the upper part of the container 24. The gasket 80 is also provided with a pair of notches 126 to permit the passage of the alignment members 122.

Figure 8:
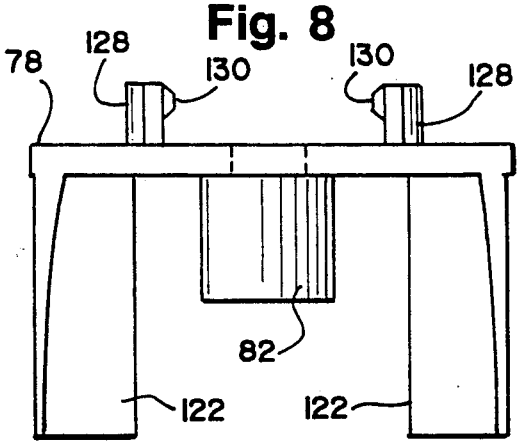
FIG. 8 is an elevational view of the valve assembly.

With reference to FIGS. 6 and 8, it will be seen that projecting from the pump side of the disc 78 are a pair of diametrically oppositely disposed alignment members 128. The alignment members 128 are provided with opposed projections 130. The alignment members 128 fit within the annular recess 56 and the projections or detents 130 fit within the notches or grooves 64 to prevent relative rotation of the valve assembly 76 relative to the pump. It will be seen that the alignment members 128 pass through the openings 74 and the pump side gasket 66.

Figure 5:
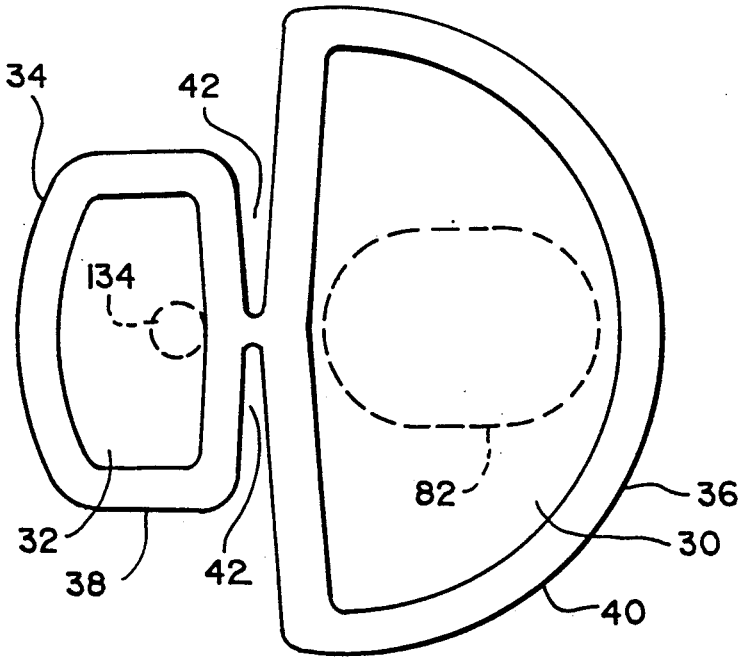
FIG. 5 is a plan view of the mouth end only of the container and schematically shows the location of flow control valves with respect to the mouth of the container.

At this time it is to be noted that the disc 78 has extending therethrough remote from the valve unit body 82 an opening or bore 132. The opening 132 is aligned with a similar opening 134 through the container side gasket 80 for communication with the pickup tube 32 as shown in FIG. 5. The opening 132 is also in alignment with the opening 72 through the pump side gasket 66 and thus in communication with the pickup opening 62 through the annular recess 56.

Figure 4:
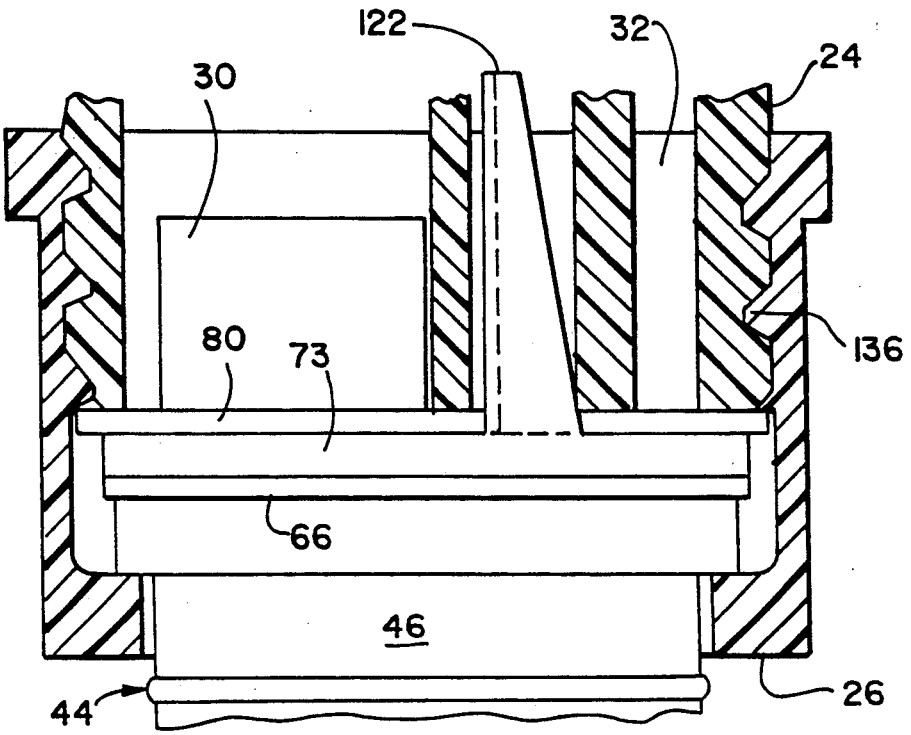
FIG. 4 is a sectional view taken through the connection between the pump and the container with the pump nut and container being shown in section and the valve assembly and a pickup portion of the pump being shown in elevation.

Referring now to FIG. 4, it will be seen that the nut 26 is provided with internal threads 136 which engage the threads 34, 36 of the container 24 and thereby clamps the gasket 80 against the sealing surface of the container 26 by way of the disc 78 and also clamps the faces of the plug 54 and the annular portion 58 of the body 46 against the gasket 66 to form a seal. It is to be further noted that the gasket 80 is of a greater diameter than other components and locks behind the uppermost threads 136 to retain all of the components as an assembly when the pump 22 and the valve assembly 76 are separate from the container 24.

OPERATION

When the container 24 is in a normal upright position, the pickup tube 32 is in communication with the pump pickup and liquid is drawn up through the pickup tube by the action of the pump 22 so as to pump liquid from the container. At this time the ball check valve 88 is released from its seat 86 by gravity and as the liquid is dispensed from the container, air is free to flow into the container from the center hole 60 provided in the flow control unit 44 open to the pump body 22.

When the container is inverted, the ball check valve 88 automatically seats on its seat 86 to close the vent passage 84. On the other hand, the weight of the liquid within the container on the ball check valve 102 is generally sufficient to overcome the action of the spring 104, aided by pump suction and especially when the container is almost empty, and liquid flows from within the container to the pump assembly (not shown) of the pump 22. Should the vacuum within the container 24 becomes sufficiently great, the ball check valve 88 will automatically unseat itself so as to vent the container.

Although the pickup tube 32 will still be in communication with the pump 22, it will be apparent that the liquid level within the pickup tube 32, in the inverted position of the container 24, will remain the same height as that of the liquid within the body of the container. Accordingly, there is no danger of the pump 22 losing its prime.

Although only a preferred embodiment of the valve assembly and its relationship to the pump and the container has been specifically illustrated and described for use of the container in an inverted position, it is to be understood that minor variations may be made in the valve assembly without departing from the spirit and scope of the invention as defined by the appended claims.

I claim:

1. A valve assembly for an adapter for coupling a manual pump to a container for dispensing a liquid from such container with such container in an inverted position, said valve assembly comprising a disc adapted to seal a pump from a container body, a valve unit carried by said disc and including a vent passage and a liquid passage through said disc, a floating check valve for closings aid vent passage only in an inverted position of said valve unit, and a spring loaded check valve seated against said liquid passage when said container is in an upright position, said spring loaded check valve being loaded for unseating by liquid pressure from liquid seated thereof when said container is in an inverted position.

2. A valve assembly according to claim 1 wherein said disc has a pump side and a container side, and said valve unit projects from said container side.

3. A valve assembly according to claim 2 wherein said check valves are located remote from said disc.

4. A valve assembly according to claim 2 wherein said check valves each include a metal ball wherein said metal balls automatically open said vent passage and automatically close said liquid passage when said container is in an upright position.

5. A valve assembly according to claim 3 wherein said check valves each include a metal ball wherein said metal balls automatically open said vent passage and automatically close said liquid passage when said container is in an upright position.

6. A valve assembly according to claim 1 wherein said disc has a pump side and a container side and gasket means for sealing said vent passage to a pump vent and said liquid passage to a pump pickup.

7. A valve assembly according to claim 1 wherein said disc has a pump side and a container side and gasket means for sealing said disc and said valve unit relative to a container mouth.

8. A valve assembly according to claim 1 wherein said disc has a separate liquid passage therethrough for cooperation with a pickup tube to supply liquid to said pump when said container is in an upright position.

9. A valve assembly according to claim 8 wherein said disc has a pump side and a container side and gasket means for sealing said vent passage to a pump vent and said liquid passage to a pump pickup, said gasket means also having passage means therethrough for also communicating said separate liquid passage with a pump pickup.

10. A valve assembly according to claim 1 wherein said spring loaded check valve includes a bore defining said liquid passage, a valve seat at one end of said bore, said spring loaded check valve being a ball held against said seat by a spring, and a tape member bonded to said disc retaining said spring in said bore with said spring resiliently pressing said ball against said seat.

11. A valve assembly according to claim 10 wherein said spring is carried by a spring retainer seated in said bore and carried by said tape member.

12. A valve assembly according to claim 11 wherein said spring retainer has axially extending fluid passages formed in an exterior thereof in circumferentially spaced relation, and said tape member has openings therethrough aligned with said axially extending fluid passages.

13. A pump and container assembly having therebetween a valve assembly for facilitating dispensing a liquid from said container when said container is in an inverted position, said pump including a flow control member having a container end including a central plug and an outer surface separated by an annular recess, a vent opening through said central plug and a liquid pickup passage opening into said annular recess, said valve assembly including a disc clamped between a mouth of said container and said flow control member in sealed relation, a valve unit carried by said disc and including a vent passage and a liquid passage through said disc, a floating check valve for closing said vent passage only in an inverted position of said valve unit, and a spring loaded check valve seated against said liquid passage when said container is in an upright position, said spring loaded check valve being loaded for unseating by liquid pressure from liquid seated thereon when said container is in an inverted position.

14. A pump and container assembly according to claim 13 wherein said vent passage is sealed relative to a pump vent in communication with the interior of said container through said mouth, and said liquid passage is sealed to said annular recess and in communication with said container interior.

15. A pump and container assembly according to claim 13 wherein said container has an integral pickup tube separated from said mouth, and said disc has a pickup opening therethrough, said pickup opening being sealed to said pickup tube and said annular recess for supplying liquid from said container to said pump when said container is in an upright position.

16. A pump and container assembly according to claim 13 wherein said valve unit projects from an underside from said disc into the mouth of said container.

17. A pump and container assembly according to claim 15 wherein said check valves each include a metal ball with said metal balls automatically opening said vent passage and automatically closing said liquid passage when said container is in an upright position.

18. A pump and container assembly according to claim 13 wherein said spring loaded check valve includes a bore defining said liquid passage, a valve seat at one end of said bore, said spring loaded check valve being a ball held against said seat by a spring.

19. A pump and container assembly according to claim 18 wherein said spring is carried by a spring retainer seated in said bore and carried by a tape member.

20. A pump and container assembly according to claim 19 wherein said spring retainer has axially extending fluid passages formed in an exterior thereof in circumferentially spaced relation, and said tape member has openings therethrough aligned with said axially extending fluid passages.

* * * * *